US011518605B1

(12) United States Patent
Schnell et al.

(10) Patent No.: US 11,518,605 B1
(45) Date of Patent: Dec. 6, 2022

(54) PACKAGING UNIT

(71) Applicant: Moulded Fibre Technologies, Inc., Clinton, IA (US)

(72) Inventors: William J. Schnell, Middleville, MI (US); Thomas L. Stanhope, Cumberland Center, ME (US); Andrew D. Beyer, Comstock Park, MI (US)

(73) Assignee: Moulded Fibre Technologies, Inc., Linton, IA (US)

( * ) Notice: Subject to any disclaimer, the term of this patent is extended or adjusted under 35 U.S.C. 154(b) by 0 days.

(21) Appl. No.: 17/317,405

(22) Filed: May 11, 2021

Related U.S. Application Data

(60) Provisional application No. 63/022,782, filed on May 11, 2020.

(51) Int. Cl.

| | |
|---|---|
| ***B65D 85/30*** | (2006.01) |
| ***B65D 71/72*** | (2006.01) |
| ***B65D 5/50*** | (2006.01) |
| ***B65D 81/133*** | (2006.01) |
| ***B65D 71/36*** | (2006.01) |

(52) U.S. Cl.
CPC ..... *B65D 85/305* (2013.01); *B65D 5/503* (2013.01); *B65D 71/36* (2013.01); *B65D 71/72* (2013.01); *B65D 81/133* (2013.01)

(58) Field of Classification Search
CPC ..... B65B 21/02; B65D 5/50; B65D 5/503; B65D 25/10; B65D 25/108; B65D 71/36; B65D 71/40; B65D 71/70; B65D 71/72; B65D 81/02; B65D 81/133; B65D 85/30; B65D 85/305
USPC ..... 206/139–160, 199, 201, 427
See application file for complete search history.

(56) References Cited

U.S. PATENT DOCUMENTS

| | | | | |
|---|---|---|---|---|
| 5,624,032 | A * | 4/1997 | Yucknut | B65D 5/5059 206/433 |
| 6,325,210 | B1 * | 12/2001 | Henry, Jr. | B65D 5/503 206/427 |
| 8,434,620 | B2 | 5/2013 | Hall | |
| 8,701,884 | B2 * | 4/2014 | Williams | B65D 81/113 206/139 |
| 10,124,924 | B2 * | 11/2018 | Gilligan | B65D 1/30 |
| 10,507,950 | B2 * | 12/2019 | Carrier | B65D 81/133 |
| 10,696,441 | B2 * | 6/2020 | Gilligan | B65D 81/133 |
| 11,104,471 | B2 * | 8/2021 | Gilligan | B65D 81/133 |

(Continued)

*Primary Examiner* — Bryon P Gehman
(74) *Attorney, Agent, or Firm* — Howard & Howard Attorneys PLLC

(57) ABSTRACT

A packaging unit includes a carton having top and bottom surfaces and side walls extending between said top and bottom surfaces. The unit further includes molded pulp fiber bottom and top trays, with each tray defining a plurality of securement chambers. The unit further includes a self-adjustable, middle dunnage including a main body disposed between the molded fiber bottom and top trays. The main body includes a plurality of holes extending through the main body and a plurality of slots extending from a perimeter of each of the holes to define a plurality of self-adjustable tabs surrounding each of the holes. The middle dunnage further includes a first plurality of foldable flaps extending from the main body towards the bottom surface and a second plurality of foldable flaps extending the main body towards the top surface of the carton.

20 Claims, 6 Drawing Sheets

(56) References Cited

U.S. PATENT DOCUMENTS

2019/0315564 A1* 10/2019 Chung ..... B65D 25/108
2021/0130059 A1* 5/2021 Hurley ..... B65D 71/46

* cited by examiner

PACKAGING UNIT

CROSS REFERENCE TO RELATED APPLICATIONS

This application claims priority to and the benefit of U.S. Provisional Patent Application No. 63/022,782 filed on May 11, 2020, which is hereby incorporated by reference in its entirety.

FIELD OF THE DISCLOSURE

The present disclosure generally relates to a packaging unit. The packaging unit is useful for securing multiple articles, such as wine bottles.

SUMMARY OF THE DISCLOSURE AND ADVANTAGES

A packaging unit includes a carton having a top surface, bottom surface, and side walls extending between the top and bottom surfaces, with access into the carton through at least one of the top and bottom surfaces. The packaging unit also includes a molded pulp fiber bottom tray supported on the bottom surface and defining a plurality of lower securement chambers. The packaging unit further includes a molded pulp fiber top tray disposed above the molded pulp fiber bottom tray and defining a plurality of upper securement chambers. The packaging unit further includes a self-adjustable, middle dunnage. The self-adjustable, middle dunnage includes a main body disposed between the molded fiber bottom and top trays. The main body includes a plurality of holes extending through the main body. The main body also includes a plurality of slots extending from a perimeter of each of the holes to define a plurality of self-adjustable tabs surrounding each of the holes. The self-adjustable middle dunnage also includes a first plurality of foldable flaps extending from the main body towards and engaging the bottom surface of the carton to support the self-adjustable, middle dunnage. The self-adjustable middle dunnage also includes a second plurality of foldable flaps extending from the main body towards the top surface of the carton.

A method for assembling the packaging unit is also provided.

BRIEF DESCRIPTION OF THE DRAWINGS

The advantages of the present disclosure will be readily appreciated as the same becomes better understood by reference to the following detailed description when considered in connection with the accompanying drawings. It is to be understood that the drawings are purely illustrative and are not necessarily drawn to scale.

DETAILED DESCRIPTION

Figure 1:
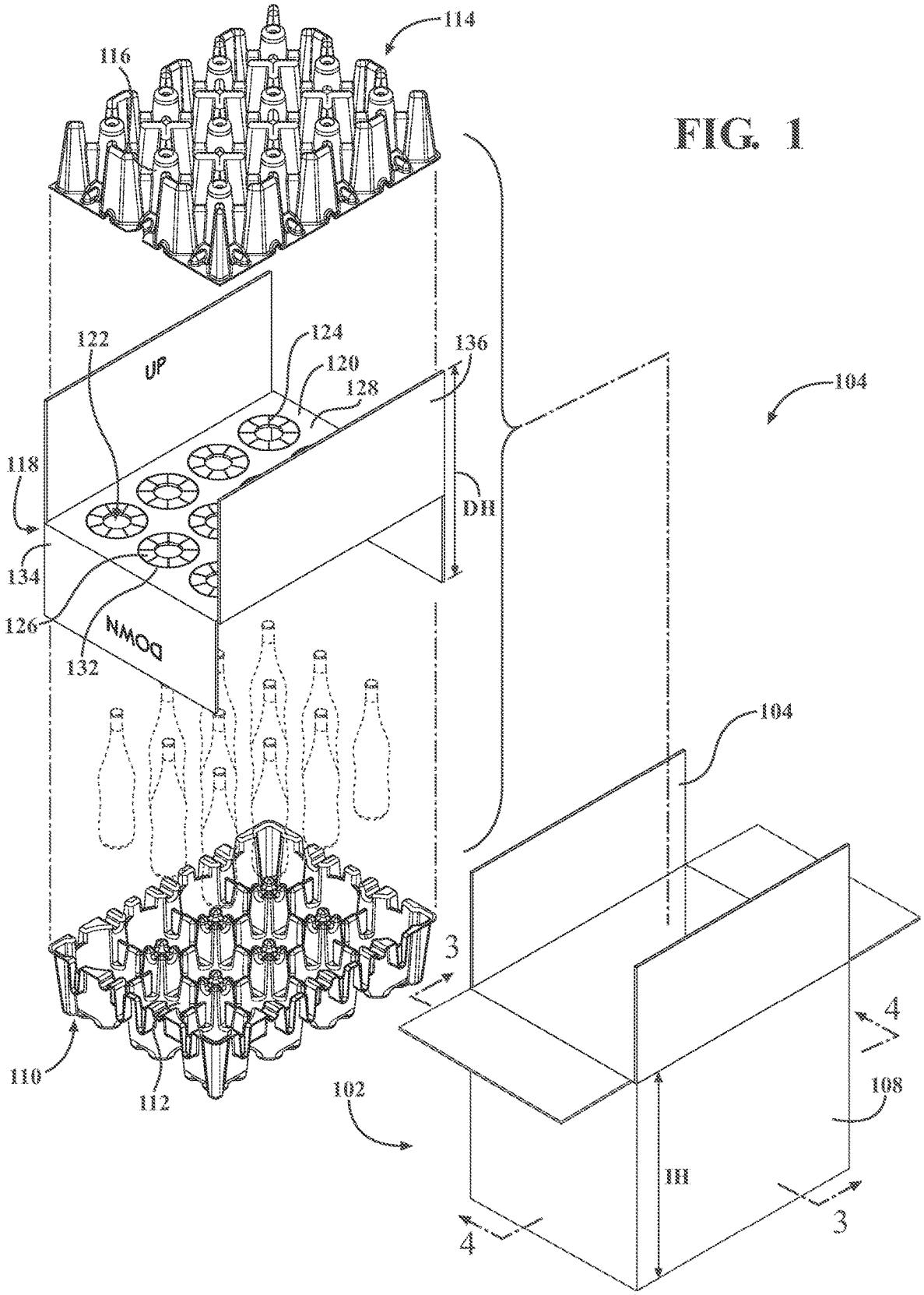
FIG. 1 is an exploded view of a packaging unit.

The present disclosure provides a packaging unit 100. The packaging unit 100 is generally considered to be lightweight except for the weight of articles secured therein and has a suitable stiffness for resistance to deflection and to satisfy load bearing requirements. As shown in FIG. 1, the packaging unit 100 includes a carton 102 having a top surface 104, a bottom surface 106, and side walls 108 extending between the top and bottom surfaces 104, 106, with access into the carton 102 through at least one of the top and bottom surfaces 104, 106. Typically, the carton 102 is more commonly referred to as a corrugated cardboard box. However, the carton 102 could be formed from other materials, such as corrugated plastic (such as Corplast®), chip board, paper board or any suitable corrugated cardboard replacement. When the carton 102 is the corrugated cardboard box, either single wall, double wall, or generally multi-wall (e.g., more than two walls) corrugated cardboard may be used.

Figure 3:
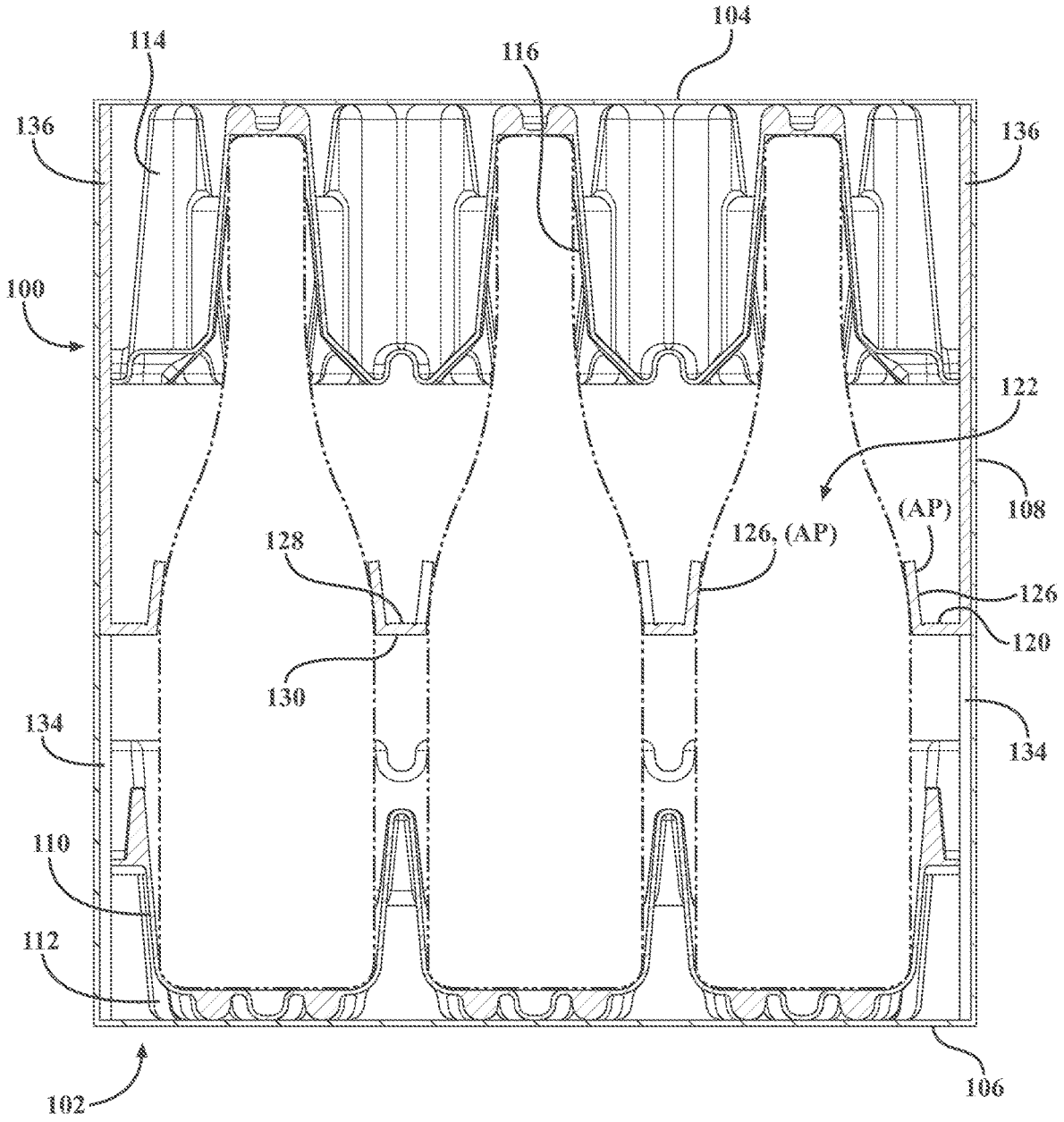
FIG. 3 is a cross-sectional view of the packaging unit of FIG. 1 taken along axis 3.
Figure 4:
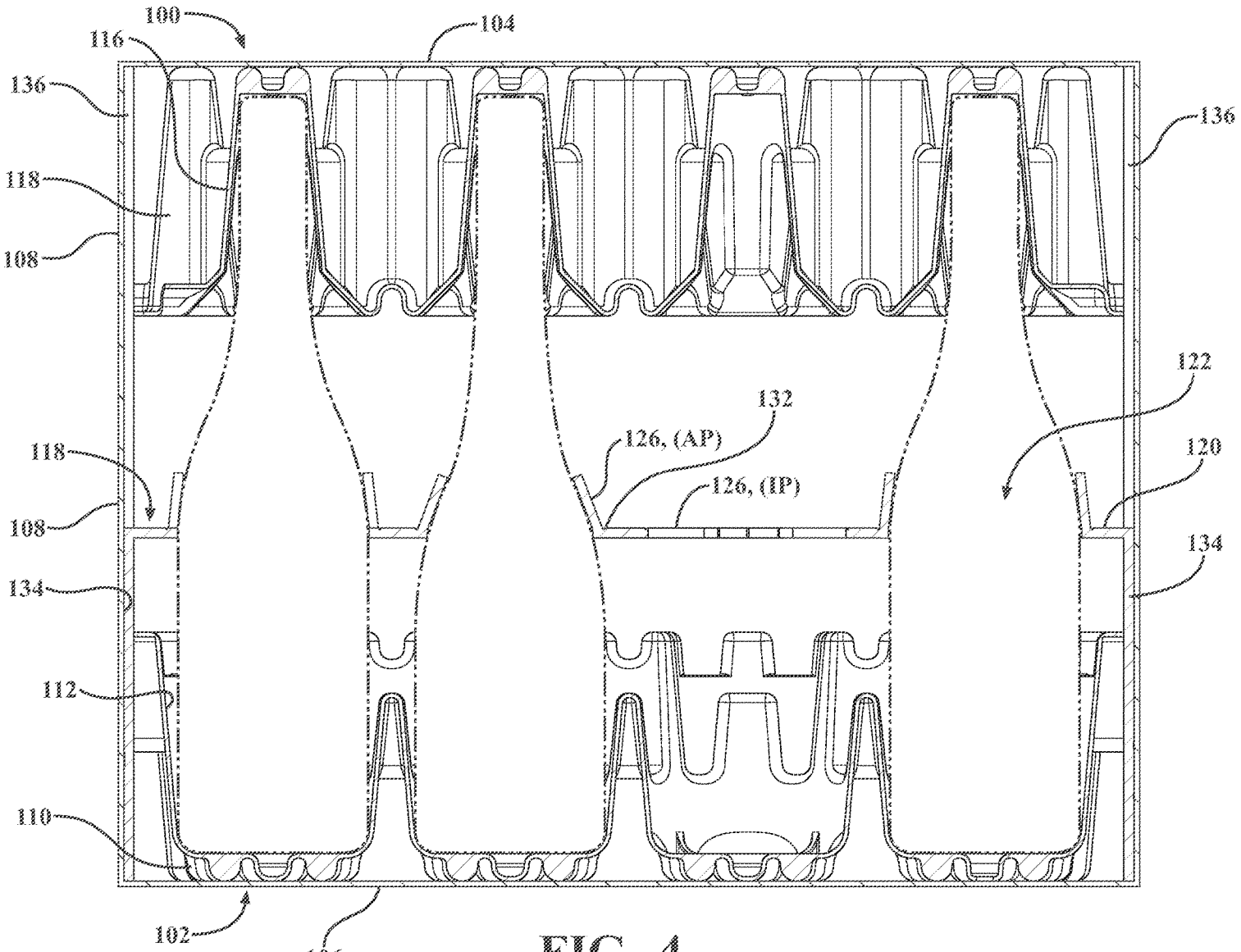
FIG. 4 is a cross-sectional view of the packaging unit of FIG. 1 taken along axis 4.

The packaging unit 100 also includes a molded pulp fiber bottom tray 110 supported on the bottom surface 106 of the carton 102. As best shown in FIGS. 1, 3, and 4, the molded pulp fiber bottom tray 110 defines a plurality of lower securement chambers 112. The lower securement chambers 112 are configured to accept a lower portion of a variety of differently shaped articles. Molded pulp fiber bottom trays designed to accept a variety of sized articles are known to persons having ordinary skill in the art. For example, U.S. Pat. No. 8,434,620 discloses a molded pulp fiber bottom tray that is suitable for use with this disclosure. The subject matter of U.S. Pat. No. 8,434,620 for its disclosure pertaining to its molded pulp fiber bottom tray is hereby expressly incorporated by reference. The lower securement chambers 112 are oriented upward towards the top surface 104 of the carton 102. For the purposes of this disclosure, it is to be appreciated that any reference to an object being oriented with respect to the top surface 104 of the carton 102 refers to the location of the top surface 104 when the top surface 104 is in a closed position (i.e., the carton 102 does not have an open face permitting access therein).

With continued reference to FIGS. 1, 3, and 4, the packaging unit 100 further includes a molded pulp fiber top tray 114 disposed above the molded pulp fiber bottom tray 110. The molded pulp fiber top tray 114 includes a plurality of upper securement chambers 116. The upper securement chambers 116 are configured to accept a variety of differently shaped articles. The geometry of the upper securement chambers 116 is typically different than the geometry of the lower securement chambers 112. Molded pulp fiber top trays designed to accept a variety of sized articles are known to persons having ordinary skill in the art. For example, U.S. Pat. No. 8,434,620 discloses a molded pulp fiber top tray that is suitable for use with this disclosure. The subject matter of U.S. Pat. No. 8,434,620 for its disclosure pertaining to its molded pulp fiber top tray is hereby expressly incorporated by reference. The upper securement chambers 116 are oriented downwards towards the bottom surface 106 of the carton 102. For the purposes of this disclosure, it is to be appreciated that any reference to an object being oriented with respect to the bottom surface 106 of the carton 102 refers to the location of the bottom surface 106 when the bottom surface 106 is in a closed position (i.e., the carton 102 does not have an open face permitting access therein).

Figure 2:
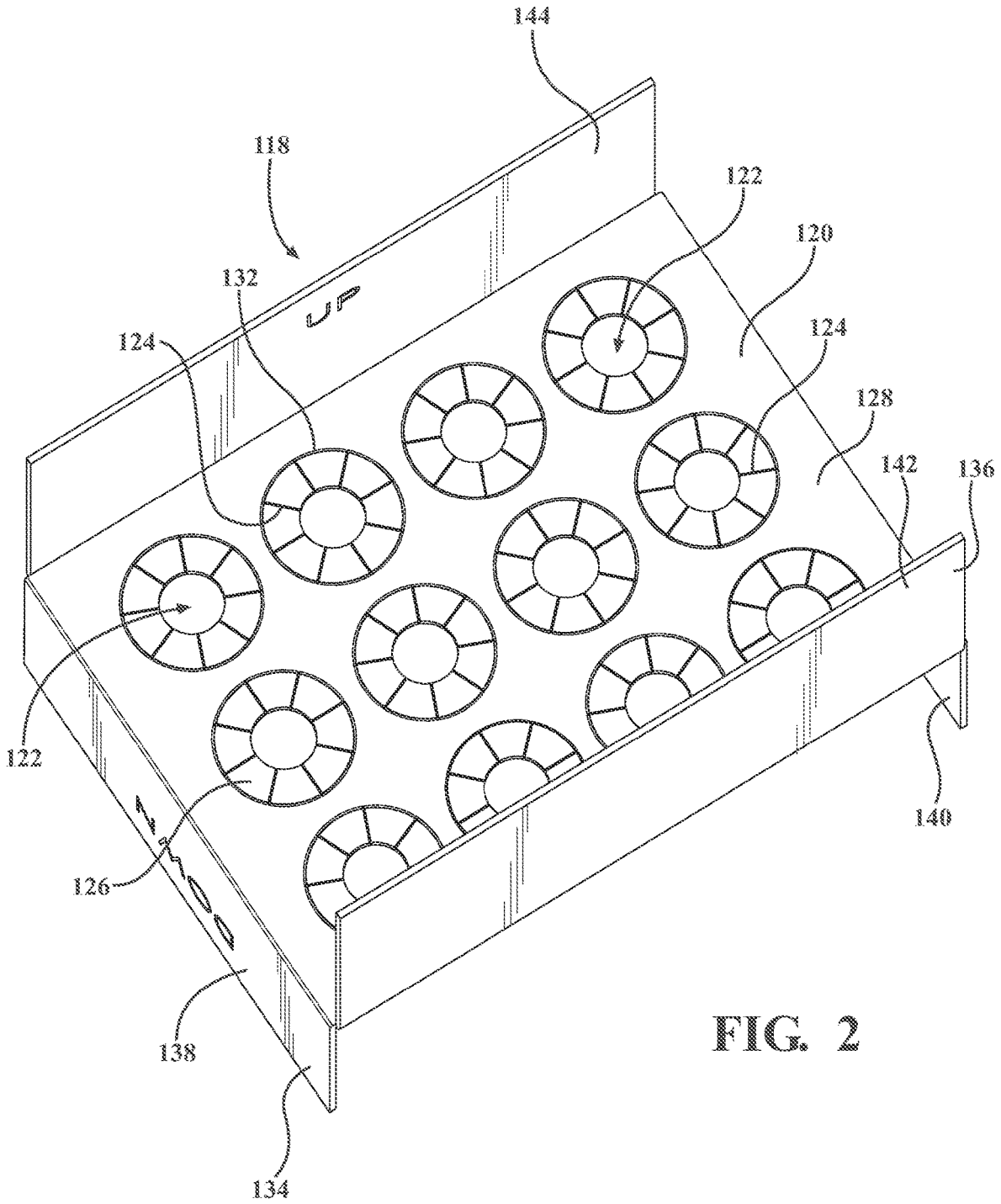
FIG. 2 is a perspective view of a self-adjustable middle dunnage with a plurality of self-adjustable tabs shown in an initial position (IP).

As best shown in FIG. 2, the packaging unit 100 further includes a self-adjustable, middle dunnage 118. The self-adjustable, middle dunnage 118 (referred to herein as simply "the middle dunnage 118") includes a main body 120, disposed between the molded pulp fiber bottom and top trays 110, 114. As best shown in FIGS. 1, 3, and 4, typically, the main body 120 extends substantially parallel with the top and bottom surfaces 104, 106 of the carton 102. The term "substantially" within the phrase "extends substantially parallel" means parallel +/−10 degrees from parallel. Referring back to FIG. 2, the main body 120 also includes or defines a plurality of holes 122 extending through the main body 120. The holes 122 may have any geometry. For example, the cross-section of the holes may be rectangular, square, hexagonal, circular, etc. Typically, the holes 122 have a generally circular cross-section. A plurality of slots 124 extends from a perimeter of each hole 122 to define a plurality of self-adjustable tabs 126 surrounding each hole 122. Within the context of this disclosure, "perimeter" means the portion of the main body 120 that defines the hole 122. For example, when the hole 122 has generally circular cross-section, the perimeter is the circumference of the circular cross-section of the hole 122. As described in further detail below, the self-adjustable tabs 126 are advantageous because they increase the versatility of the middle dunnage 118 by allowing the middle dunnage 118 to accept and secure a variety of articles within each hole 122. The articles are not limited to any particular article. Nonlimiting examples of the article include containers (such as wine bottles of varying shapes and sizes), glass articles (such as candle sticks), construction equipment, medical devices, ceramic articles, etc.

Referring back to the plurality of holes 122, typically the middle dunnage 118 includes at least two holes 122. More typically, the middle dunnage 118 includes, 3, 4, 6, 8, 9, 10, 12, 14, 15, or 18 holes 122. In one embodiment, the middle dunnage 118 includes 12 holes 122, with the holes 122 arranged in three columns and four rows, or vice versa.

Referring now to the plurality of slots 124 extending from each hole 122, typically, the middle dunnage 118 includes at least two slots 124. More typically, the middle dunnage 118 includes 4, 6, or 8 slots 124, with the slots 124 equally spaced around the perimeter (e.g., the circumference when the hole 122 is circularly shaped) of the hole 122. In one embodiment, the middle dunnage 118 includes 8 slots 124, with each slot 124 equally spaced around the perimeter of hole 122. Although not required, if the length of the slots 124 around a particular hole 122 were to be extrapolated across the void of the hole 122, each slot 124 would intersect at the center point of the hole 122. Typically, the slots 124 are equally spaced around the hole 122. For example, when the middle dunnage 118 includes 8 slots 124, the center of each slot 124 is approximately 45 degrees from the center of each adjacent slot 124. When the middle dunnage 118 includes 8 slots 124 around a hole 122, the slots 124 and the hole 122 collectively define 8 self-adjustable tabs 126. Typically, the middle dunnage 118, via the holes 122 and self-adjustable tabs 126, can accommodate articles (e.g., a wine bottle) with a diameter up to 3.5 inches. As shown in FIG. 2, the self-adjustable tabs 126 are present in an initial position (IP) that is co-planar with the main body 120 when the self-adjustable tabs 126 are not engaged with the article. As best shown in FIGS. 3 and 4, when the self-adjustable tabs 126 are engaged with an article, the article articulates the self-adjustable tabs 126 upward to an articulated position (AP) and away from the bottom surface 106 of the carton 102. The geometry of the article will determine the degree of articulation.

Figure 6:
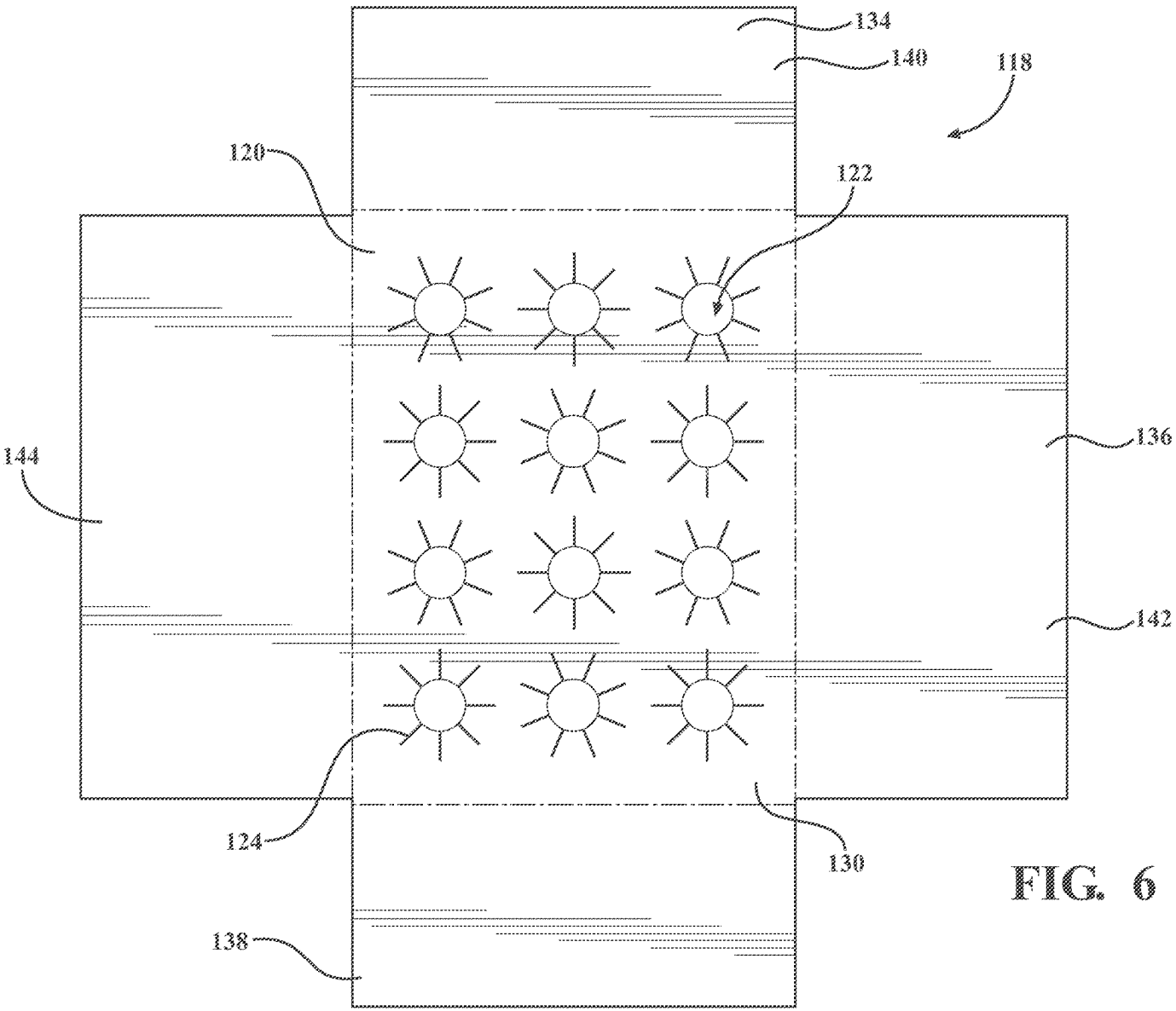
FIG. 6 is a bottom view of the self-adjustable middle dunnage shown in the flattened position.

Referring back to the main body 120 of the middle dunnage 118, the main body 120 includes a top dunnage surface 128 facing the top surface 104 of the carton 102 and a bottom dunnage surface 130, opposite and spaced from the top dunnage surface 128 by the width of the main body 120, facing the bottom surface 106 of the carton 102. As best shown in FIG. 2, the main body 120 of the middle dunnage 118 may include a plurality of creases 132, with each crease 132 connecting each distal end of the plurality of slots 124 extending from the perimeter of a particular hole 122, to further define the plurality of self-adjustable tabs 126 around the particular hole 122. When the hole 122 is circular in shape, the crease 132 is also typically circular in shape. When present, as shown in FIG. 2, the creases 132 are formed on the top dunnage surface 128. Said differently, as shown in FIG. 6, the creases 132 are not present on the bottom dunnage surface 130.

As further shown in FIG. 2, the middle dunnage 118 includes a first plurality of foldable flaps 134 extending from the main body 120 towards and engaging the bottom surface 106 of the carton 102 to support the middle dunnage 118. The middle dunnage 118 further includes a second plurality of foldable flaps 136 extending from the main body 120 towards the top surface 104 of the carton 102. When the self-adjustable tabs 126 are articulated from the initial position (IP) to an articulated position (AP), the self-adjustable tabs 126 articulate about the crease 132, when included in the packaging unit 100. Accordingly, in embodiments including the circular creases 132, the self-adjustable tabs 126 are collectively defined by the hole 122, the plurality of slots 124 surrounding the hole 122 (e.g. a hole with a circular cross-section), and the circular crease 132 surrounding each slot 124.

Figure 5:
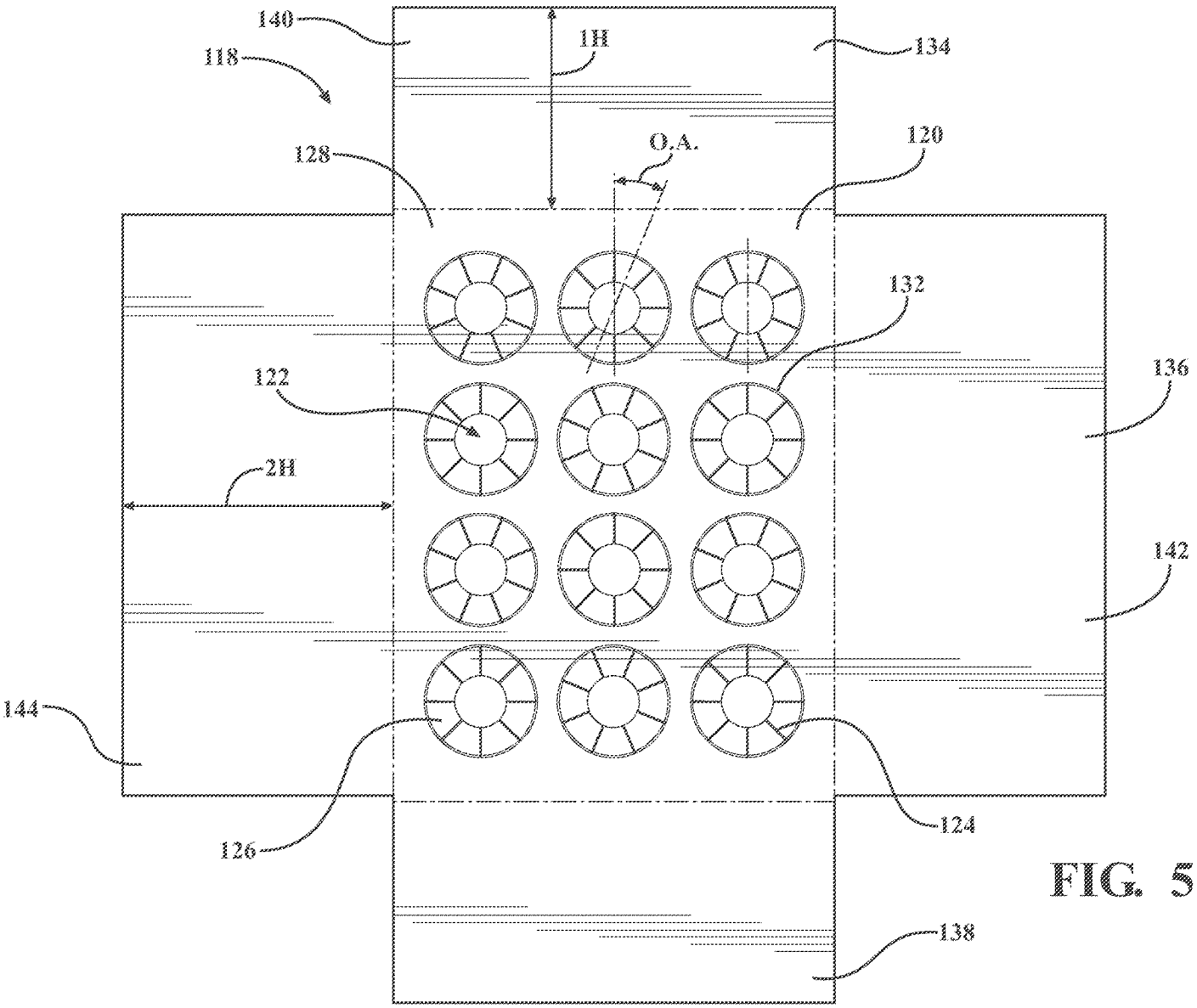
FIG. 5 is a top view of the self-adjustable middle dunnage shown in a flattened position.

As best shown in FIGS. 1, 2, 5, and 6, in certain embodiments, the plurality of holes 122 of the middle dunnage 118 are arranged in a plurality of rows and a plurality of columns. Although not required, in these embodiments, the orientation of the equally spaced slots 124 around a particular hole 122 is offset by an angle (O.A.) of from about 18 to about 26 degrees from an orientation of the plurality of slots 124 on each laterally adjacent and vertically adjacent hole 122. An example of the offset angle (O.A.) is shown in FIG. 5. Alternatively, the offset angle (O.A.) may be from about 20 to about 24, or about 22.5 degrees. Offsetting the plurality of slots 124 by the offset angle (O.A.) from about 18 to about 26 degrees strengthens the main body 120 by preventing the slots 124 from adjacent vertical and lateral holes 122 from aligning.

Referring back to the main body 120 of the middle dunnage 118, typically, the main body 120 is rectangular. As shown in FIGS. 3 and 4, typically, the first plurality of foldable flaps 134 extend substantially perpendicular from the main body 120 towards and engaging the bottom surface 106 of the carton 102. Because, the first plurality of foldable flaps 134 directly contact the bottom surface 106, the first plurality of foldable flaps 134 are spaced from each other by at least the length or width of the molded pulp fiber bottom tray 110. In other words, the distance between the first plurality of foldable flaps 134 is greater than either the width or length of the molded pulp fiber bottom tray 110 such that the flaps 134 engage the bottom surface 106 of the carton 102 and are not directly supported on or by the molded pulp fiber bottom tray 110. As further shown in FIGS. 3 and 4, typically the second plurality of foldable flaps 136 extend substantially perpendicular from the main body 120 towards and engaging the top surface 104 of the carton 102. Because, the second plurality of foldable flaps 136 directly contact the top surface 104, the second plurality of foldable flaps 136 are spaced from each other by at least the length or width of the molded pulp fiber top tray 114. In other words, the distance between the second plurality of foldable flaps 136 is greater than either the width or length of the molded pulp fiber top tray 114 such that the flaps 136 engage the top surface 104 of the carton 102 and do not directly support the molded pulp fiber top tray 114. Within the context of this disclosure, "substantially perpendicular" means perpendicular, +/−10 degrees from perpendicular.

With reference to FIG. 1, typically, the height (DH) of the middle dunnage 118 is substantially equal to the interior height (IH) of the carton 102, which is measured between the top and bottom surfaces 104, 106 of the carton 102 when the top and bottom surfaces 104, 106 are closed. Matching the height (DH) of the middle dunnage 118 to the interior height (IH) of the carton 102 strengthens the crush resistance of the carton 102 and allows for multiple cartons 102 to be stacked on one another. When the first plurality of foldable flaps 134 is two flaps 134, the flaps 134 are further defined as a first downward flap 138 and a second downward flap 140. The first downward flap 138 is spaced from the second downward flap 140 on opposite sides of the rectangularly shaped main body 120. When the second plurality of foldable flaps 136 consists of two flaps 136, the second plurality of foldable flaps 136 is further defined as a first upward flap 142 and a second upward flap 144. Similar to the first plurality of foldable flaps 134, the first and second upward flaps 142, 144 extend from opposite sides of the rectangular main body 120. The ends of the main body 120 that the first and second upward flaps 142, 144 extend from are different than the ends of the main body 120 that the first and second downward flaps 138, 140 extend from.

Similar to the carton 102, the middle dunnage 118 can be made of corrugated cardboard, but other materials can also be used, such as corrugated plastic (e.g., Corplast®), honeycomb board (plastic or cardboard like materials), PET non-woven, molded fiber, any corrugated cardboard or variant thereof, chip board, or paper board. When the middle dunnage 118 is made of corrugated cardboard, double walled corrugated cardboard is generally preferrable. However, multi-wall corrugated cardboard (e.g., corrugated cardboard with greater than two walls) may be advantageous in extreme environments or when the article contained within the packaging unit 100 is especially fragile.

With reference to FIG. 5, typically, the first plurality of foldable flaps 134 has a first height (1H) and the second plurality of foldable flaps 136 has a second height (2H), with the first height (1H) being less than the second height (2H). In other words, the downwardly oriented flaps are shorter than the upwardly oriented flaps. When the first plurality of foldable flaps 134 is shorter than the second plurality of foldable flaps 136, the position of the main body 120 within the carton 102 is in the bottom half of the carton 102. This orientation is considered advantageous because it positions the plurality of holes 122 and self-adjustable tabs 126 towards the lower portion of the articles included in the carton 102. Because, the lower portion of many articles (e.g., wine bottles) is generally wider than their upper portion, the middle dunnage 118 is more effective at securing the articles within the carton 102.

The present disclosure also provides a method of assembling the packaging unit 100. The method includes providing the carton 102. The method then includes placing the molded pulp fiber bottom tray 110 into the carton 102 and on the bottom surface 106 of the carton 102, with lower securement chambers 112 facing upward. The method then includes placing the middle dunnage 118 in the carton 102, after placing the molded pulp fiber bottom tray 110. The method then includes placing the molded pulp fiber top tray 114 into the carton 102 above the main body 120 of the middle dunnage 118, with upper securement chambers 116 facing downward.

The method may also include placing at least one article in the carton 102 after placing the molded pulp fiber bottom tray 110 and before placing both the self-adjustable, middle dunnage 118 and the molded pulp fiber top tray 114. In this embodiment, the article (e.g., a wine bottle) includes a lower portion, middle portion, and top portion. The lower portion of the article is fit and secured within the lower securement chambers 112 of the molded pulp fiber bottom tray 110. When the middle dunnage 118 is placed in the carton 102, the upper portion of the article is aligned with the holes 122 of the middle dunnage 118. As the middle dunnage 118 is lowered into the carton, the middle portion of the article engages the self-adjustable tabs 126 and articulates the self-adjustable tabs 126 upward and away from the bottom surface 106 of the carton 102. Then the molded pulp fiber top tray 114 is placed in the carton 102 with the upper portion of the article being engaged and secured in the upper securement chambers 116 of the molded pulp fiber top tray 114. The method may then include closing the top surface 104 of the carton 102.

It is to be understood that the examples are provided for illustrative purposes and are not to be construed as limiting the scope of the present disclosure. The invention has been described in an illustrative manner, and it is be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

The invention claimed is:

1. A packaging unit comprising:

a carton having a top surface, bottom surface, and side walls extending between said top and bottom surfaces, with access into said carton through at least one of said top and bottom surfaces;

a molded pulp fiber bottom tray supported on said bottom surface and defining a plurality of lower securement chambers;

a molded pulp fiber top tray disposed above said molded fiber bottom tray and defining a plurality of upper securement chambers; and a self-adjustable, middle dunnage comprising, a main body disposed between said molded fiber bottom and top trays, said main body comprising, a plurality of holes extending through said main body; and a plurality of slots extending from a perimeter of each of said holes to define a plurality of self-adjustable tabs surrounding each of said holes;

a first plurality of foldable flaps extending from said main body towards and engaging said bottom surface of said carton to support said self-adjustable, middle dunnage, and a second plurality of foldable flaps extending from said main body towards said top surface of said carton.

2. The packaging unit as set forth in claim 1 wherein said first and second plurality of foldable flaps extend substantially perpendicular from said main body and said second plurality of foldable flaps engages said top surface of said carton to anchor said self-adjustable, middle dunnage within said carton.

3. The packaging unit as set forth in claim 1 wherein said main body has a rectangular cross-sectional shape.

4. The packaging unit as set forth in claim 3 wherein said first plurality of foldable flaps is further defined as a first downward flap and a second downward flap with said first and second downward flaps extending from opposite ends of said rectangular cross-sectional shape of said main body and wherein said second plurality of foldable flaps is further defined as a first upward flap and a second upward flap, said first and second upward flaps extending from opposite ends of said rectangular cross-sectional shape of said main body, which are different than said opposite ends from which said first plurality of foldable flaps extend.

5. The packaging unit as set forth in claim 1 wherein each hole in said plurality of holes has a generally circular cross-section such that said perimeter of each hole is further defined as a circumference and said slots extend from each circumference of said plurality of holes.

6. The packaging unit as set forth in claim 5 wherein each of said holes in said plurality of holes includes at least 4 slots equally spaced around each hole.

7. The packaging unit as set forth in claim 6 wherein said plurality of holes includes at least 4 holes.

8. The packaging unit as set forth in claim 6 wherein said plurality of holes is further defined as 12 holes.

9. The packaging unit as set forth in claim 6 wherein each said plurality of slots has 8 slots equally spaced around each hole.

10. The packaging unit as set forth in claim 9 wherein an orientation of said plurality of slots for each of said holes are offset from about 18 to about 26 degrees from an orientation of said plurality of slots on each laterally adjacent and vertically adjacent hole.

11. The packaging unit as set forth in claim 1 wherein said first plurality of foldable flaps have a first height and said second plurality of foldable flaps have a second height, with said first height being less than said second height.

12. The packaging unit as set forth in claim 1 wherein said main body of said self-adjustable, middle dunnage extends substantially parallel with said bottom and top surfaces of said carton.

13. The packaging unit as set forth in claim 1 wherein said main body further comprises a plurality of creases, with each crease connecting each distal end of said plurality of slots extending from said perimeter of a hole, to further define said plurality of self-adjustable tabs.

14. The packaging unit as set forth in claim 13 wherein said plurality of self-adjustable tabs are configured to articulate upwards towards said top surface of said carton about said plurality of creases.

15. The packaging unit as set forth in claim 1 defining an interior height between said bottom and top surfaces, wherein said self-adjustable, middle dunnage has a height that is substantially the same as said interior height.

16. The packaging unit as set forth in claim 1 wherein said self-adjustable, middle dunnage is formed from double-walled corrugated cardboard.

17. The packaging unit as set forth in claim 1 further comprising at least one article comprising a bottom portion, a top portion, and a middle portion, wherein:

said top portion of said at least one article is engaged within a securement chamber of said top tray;

said bottom portion of said at least one article is engaged within a securement chamber of said bottom tray; and said middle portion of said article extends through said hole of said main body of said self-adjustable, middle dunnage; and said self-adjustable tabs of said main body are in an articulated position extending away from said main body and away from said bottom surface of said carton, and wherein said self-adjustable tabs are in contact with said middle portion of said article.

18. A method of assembling a packaging unit comprising:

providing a carton having a top surface, bottom surface, and side walls extending between the top and bottom surfaces, with access into the carton through at least one of the top and bottom surfaces;

placing a molded pulp fiber bottom tray defining a plurality of lower securement chambers in the carton and on the bottom surface of the carton;

placing a self-adjustable, middle dunnage in the carton after placing the molded pulp fiber bottom tray; and placing a molded pulp fiber top tray defining a plurality of upper securement chambers in the carton after placing the self-adjustable, middle dunnage, such that the molded pulp fiber top tray is disposed above the molded pulp fiber bottom tray;

wherein the self-adjustable, middle dunnage comprises, a main body disposed between the molded fiber bottom and top trays, the main body comprising, a plurality of holes extending through the main body, and a plurality of slots extending from a perimeter of each of the holes to define a plurality of self-adjustable tabs surrounding each of the holes, a first plurality of foldable flaps extending from the main body towards and engaging the bottom surface of the carton to support the self-adjustable, middle dunnage, and, a second plurality of foldable flaps extending from the main body towards the top surface of the carton.

19. The method of claim 18 wherein the main body of the self-adjustable, middle dunnage comprises a plurality of creases, with each crease connecting each distal end of the plurality of slots extending from the perimeter of a hole, to further define the plurality of self-adjustable tabs.

20. The method of claim 18 further comprising placing an article in the carton after placing the molded pulp fiber bottom tray and before placing both the self-adjustable, middle dunnage and the molded pulp fiber top tray, wherein:

a bottom portion of the at least one article is engaged within a securement chamber of the molded pulp fiber bottom tray;

a top portion of the at least one article is engaged within a securement chamber of the molded pulp fiber top tray;

a middle portion of the article extends through the hole of the main body of the self-adjustable, middle dunnage; and the self-adjustable tabs of the main body are in an articulated position extending away from the main body and away from the bottom surface of the carton, and wherein the self-adjustable tabs are in contact with the middle portion of the article.

* * * * *